US008596963B1

(12) United States Patent
Liang

(10) Patent No.: US 8,596,963 B1
(45) Date of Patent: Dec. 3, 2013

(54) BOAS FOR A TURBINE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 392 days.

(21) Appl. No.: 13/177,619

(22) Filed: Jul. 7, 2011

(51) Int. Cl.
*F01D 25/14* (2006.01)
*F01D 11/12* (2006.01)

(52) U.S. Cl.
USPC ..... 415/116; 415/173.1; 29/889.22

(58) Field of Classification Search
USPC ..... 415/116, 115, 173.1–173.5; 416/96 R, 416/97 R
See application file for complete search history.

(56) References Cited

U.S. PATENT DOCUMENTS 5,993,150 A * 11/1999 Liotta et al. ..... 415/115
7,597,533 B1 * 10/2009 Liang ..... 415/116
7,621,719 B2 * 11/2009 Lutjen et al. ..... 415/173.1
7,704,039 B1 * 4/2010 Liang ..... 415/116
8,439,639 B2 * 5/2013 Joe et al. ..... 416/97 R

* cited by examiner

*Primary Examiner* — Edward Look
*Assistant Examiner* — William Grigos
(74) *Attorney, Agent, or Firm* — John Ryznic

(57) ABSTRACT

A ring segment for a blade outer air seal which includes an array of separated floating wall surfaces each extending from a pedestal and having an inner side with a fibrous metal pad secured and a TBC secured over the pads. The pedestals are formed by diffusion chambers formed between an outer side and an inner side of the ring segment. Purge air holes connect the diffusion chambers to the impingement cavity formed above the ring segment. Thin slots form the separated floating wall surfaces and connect the diffusion chambers to discharge cooling air through the sides of the floating wall surfaces. Cooling air holes also pass through the pedestals to discharge cooling air onto the TBC surfaces.

12 Claims, 5 Drawing Sheets

BOAS FOR A TURBINE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a blade outer air seal for a turbine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A blade outer air seal (BOAS) is formed from ring segments that are secured by hooks to a ring carrier. The ring segments each include an inner surface that forms a seal with tips of the rotating blades of the turbine. The backside of the ring segments are cooled by directing impingement cooling air onto the surface. To cool the hot side of the ring segment, spent cooling air from the impingement cavity is discharged through film cooling holes to provide for a layer of film cooling air onto the hot surface and to form a seal with the blade tips. Because the inner surface of the ring segment is exposed to the hot gas stream passing through the turbine and the outer surface is exposed to the cool impingement cooling air, a large thermal mismatch is formed within the ring segment.

The above described thermal mismatch that occurs within the ring segments can cause several problems. One is that the ring segments that form the blade outer air seal (BOAS) can warp in the circumferential direction so that a larger leakage flow path is formed in which the hot gas stream can flow. This creates hot spots around the ring segment that can lead to erosion of the material that shortens the useful life of the ring segment.

The thermally induced flexing or warping of the ring segment will also cause any thermal barrier coating (TBC) that is applied to the inner or hot surface to crack or spall off. Missing pieces of the TBC will expose the ring segment metal surface to direct hot gas stream temperature which will also shorten the useful life of the ring segment.

BRIEF SUMMARY OF THE INVENTION

A blade outer air seal formed from ring segments in which each ring segment includes an inner or hot surface formed from an array of floating wall surfaces that each extends from individual pedestals that have cooling air holes formed therein. Each floating wall surface includes a diffusion chamber formed therein with a cooling air inlet hole connected to the chamber and to an impingement cavity formed above the ring segment, and a film cooling slot opening onto the hot surface to discharge film cooling air. The inner surfaces of the floating wall surfaces have a TBC applied over a fibrous metal pad that can have cooling air channels formed therein for additional cooling capabilities. The fibrous metal pad forms a strong bonding surface for the TBC.

The ring segment is formed by casting each ring segment with the diffusion chambers formed therein, and thus cutting a rectangular array of thin slots to form the floating wall surfaces. Cooling air holes that extend through the pedestals that support each floating wall surface are drilled through the ring segment to form the cooling air holes that discharge onto the surface of the TBC. Because of the floating wall surfaces, any flexing in the circumferential direction is minimized so that stress on the ring segment hooks is eliminated. Also, the diffusion chambers form additional thermal insulation between the cooler outer surface and the hotter inner surface of the ring segment to minimize thermal stress of the ring segment. Use of the fibrous metal pad for bonding of the TBC increases the strength of the TBC bond and isolates the missmatch between the TBC and the inner surface.

DETAILED DESCRIPTION OF THE INVENTION

Figure 1:
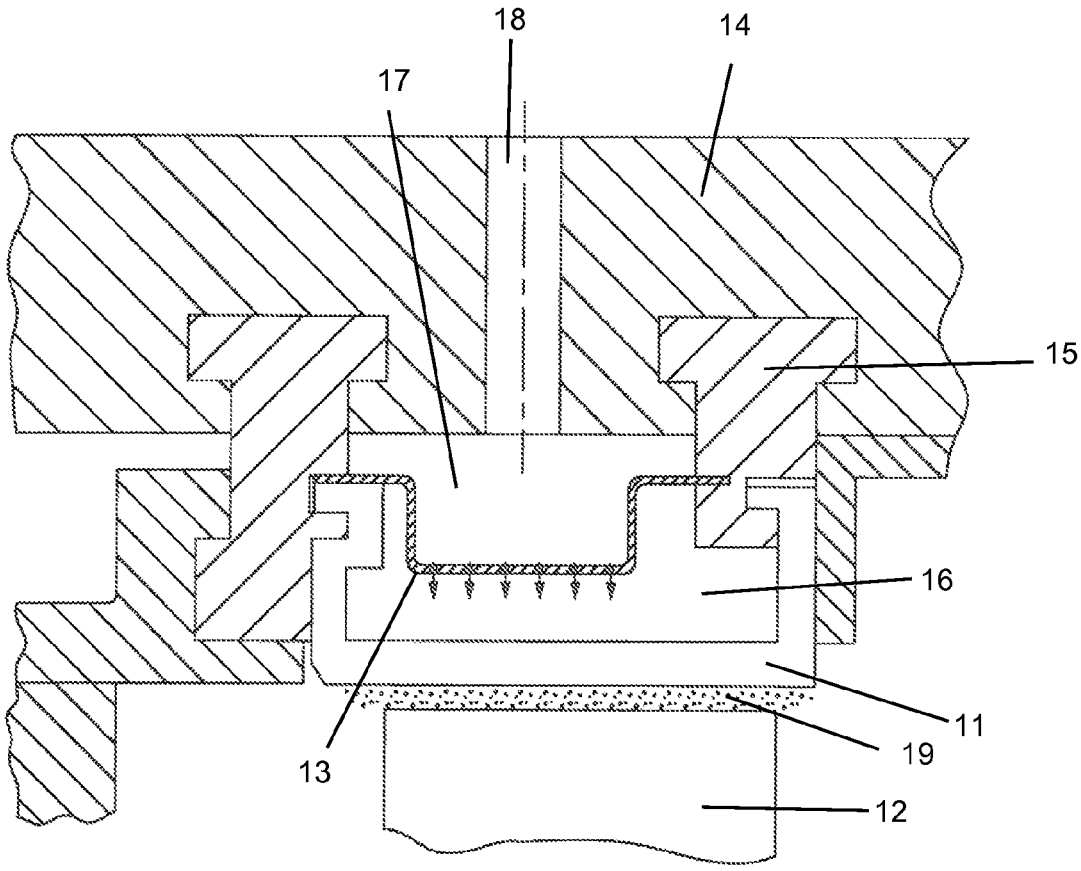
FIG. 1 shows a cross section view along a circumferential direction of the turbine with the blade outer air seal of the present invention.

The blade outer air seal (or BOAS) of the present invention is shown in FIG. 1 and includes a ring segment 11, a rotor blade tip 12 that forms a gap with an inner or hot surface of the ring segment 11, a TBC 19 applied to the inner surface of the ring segment 11, an impingement plate 13 with impingement cooling holes formed therein, an impingement cavity 16 formed between the ring segment 11 and the impingement plate 13, a forward and an aft isolation ring 15 secured to a ring carrier 14 of the turbine that holds the ring segment 11 in place using two hooks that extend outward from each ring segment 11, a cooling air supply chamber 17 and one or more cooling air supply holes 18 formed within the ring carrier 14 to supply cooling air to the ring segment 11.

Figure 2:
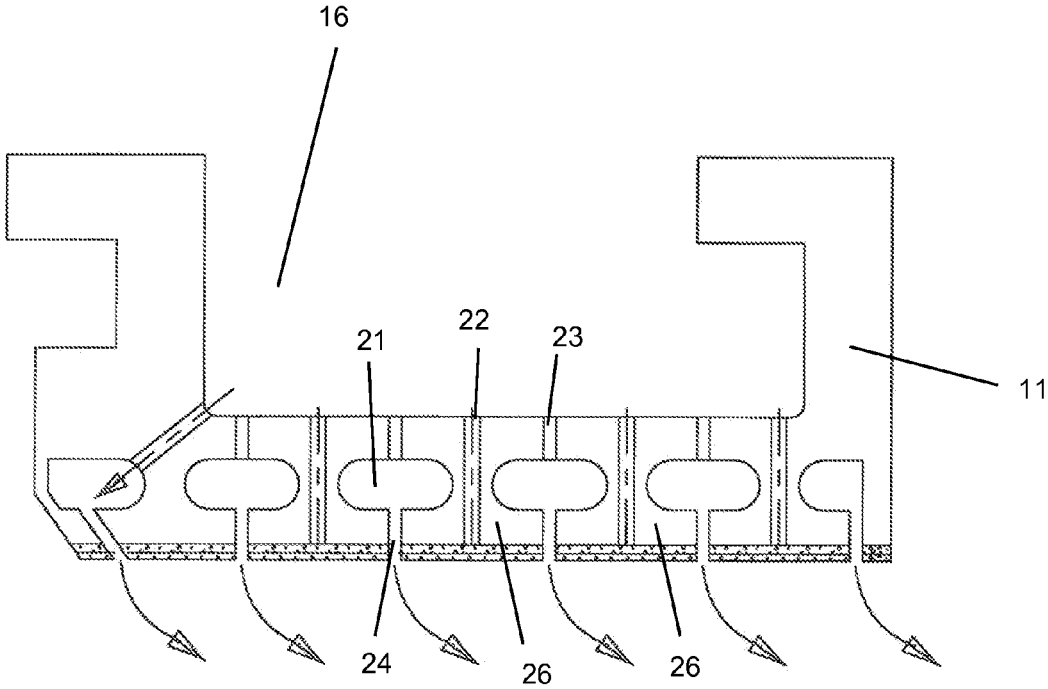
FIG. 2 shows a cross section view of the ring segment that forms the BOAS of the present invention.

FIG. 2 shows a detailed view of the ring segment 11 of the present invention with the forward and aft hooks extending upward and the impingement cavity located above the outer surface of the ring segment and the inner or hot surface formed below. The inner or hot surface of the ring segment is formed with individual floating wall surfaces 26 that are each separated by a thin slot 24 that becomes a cooling air channels. Each floating wall surface 26 includes a diffusion chamber 21 formed between cooling air holes 22 extending from a top surface to a bottom surface of the ring segment 11. The cooling air holes 22 extend from the top surface to the bottom surface of the ring segment and pass through a pedestal that forms a support structure for the individual floating wall surfaces 26 to be described below. One or more purge air holes 23 connect an impingement cavity to the diffusion chambers 21.

Figure 3:
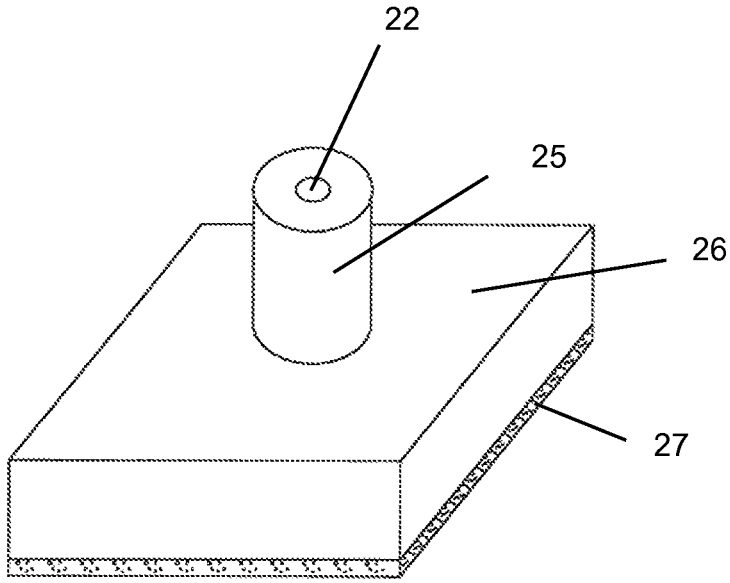
FIG. 3 show an isometric view of the floating wall surface and pedestal of the ring segment of the present invention.
Figure 4:
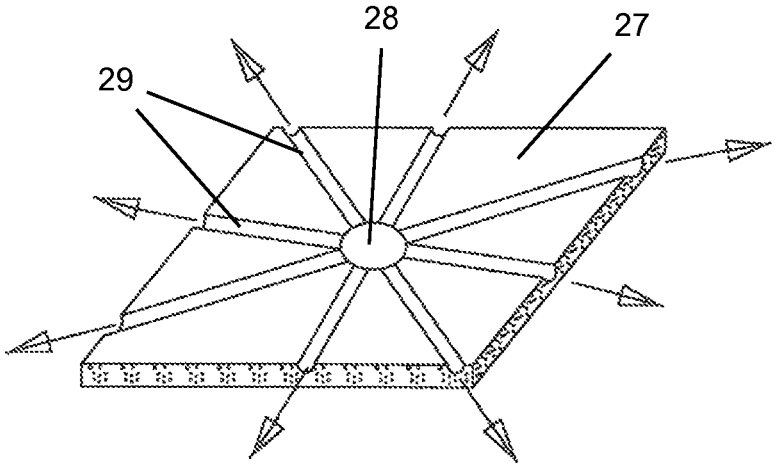
FIG. 4 shows an isometric view of the fibrous metal pad with the cooling air passages for the ring segment of the present invention.

FIG. 3 shows a view of one of the floating wall surfaces 26 of the ring segment 11 and includes a pedestal 25 extending upward. The cooling air hole 22 passes through each of the pedestals 25. A fibrous metal pad 27 is secured to a bottom side of the floating wall surface 26 and forms a bonding surface for a thermal barrier coating or TBC. The fibrous metal pad 27 is formed from a low porosity and low modulus inter-metallic fiber material. The fibrous metal pad 27 forms a rough surface on which to bond the TBC. To improve the cooling effectiveness of the ring segment 11, an arrangement of cooling air passages 29 can be formed on the top side of the pad 27 that form enclosed passages when the pad 27 is secured to the floating wall surface 26. A center cooling hole 28 is aligned with the cooling air hole 22 passing through the pedestals 25. Looking back to FIG. 2, the pedestals with the cooling air holes 22 are surrounded by the diffusion chambers 21. Another way of describing this structure is that the pedestals form the diffusion chambers 21.

Figure 5:
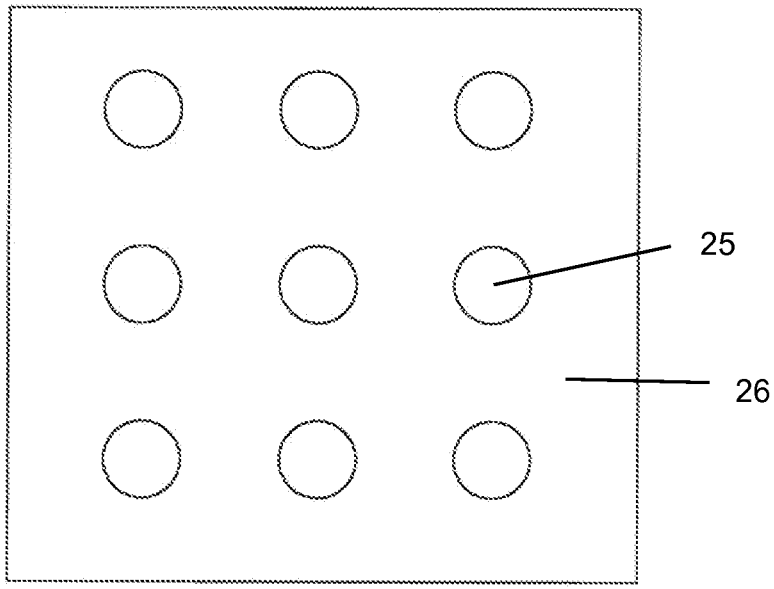
FIG. 5 shows a top view of an inner surface of the ring segment with an array of pedestals extending out for the ring segment of the present invention.
Figure 6:
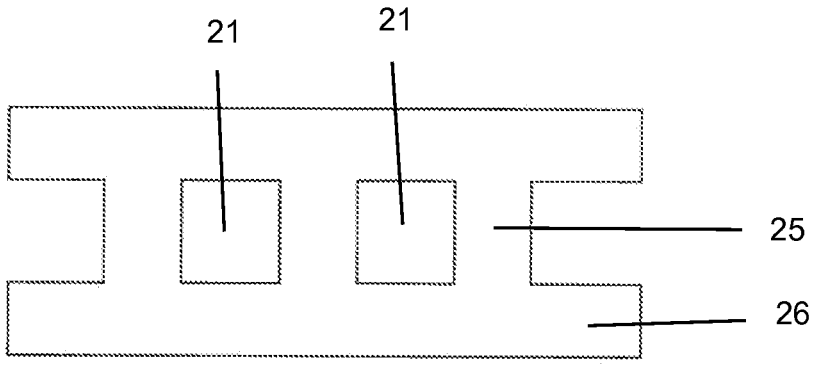
FIG. 6 shows a cross section side view through the ring segment of FIG. 5.

FIG. 5 shows a top view of the inner or hot wall surface 26 of the ring segment 11 with an array of pedestals 25. FIG. 6 shows a cross section side view of the ring segment 11 of FIG. 5 with the pedestals extending from the upper piece of the ring segment to the lower piece with the diffusion chambers 21 formed between the upper and lower pieces and the pedestals. Purge air holes 23 can be formed in the ring segment during casting so that the ceramic material used to form the diffusion chambers 21 can be leached away. When this solid ring segment has been formed from casting, the separated floating wall surfaces can then be formed.

Figure 7:
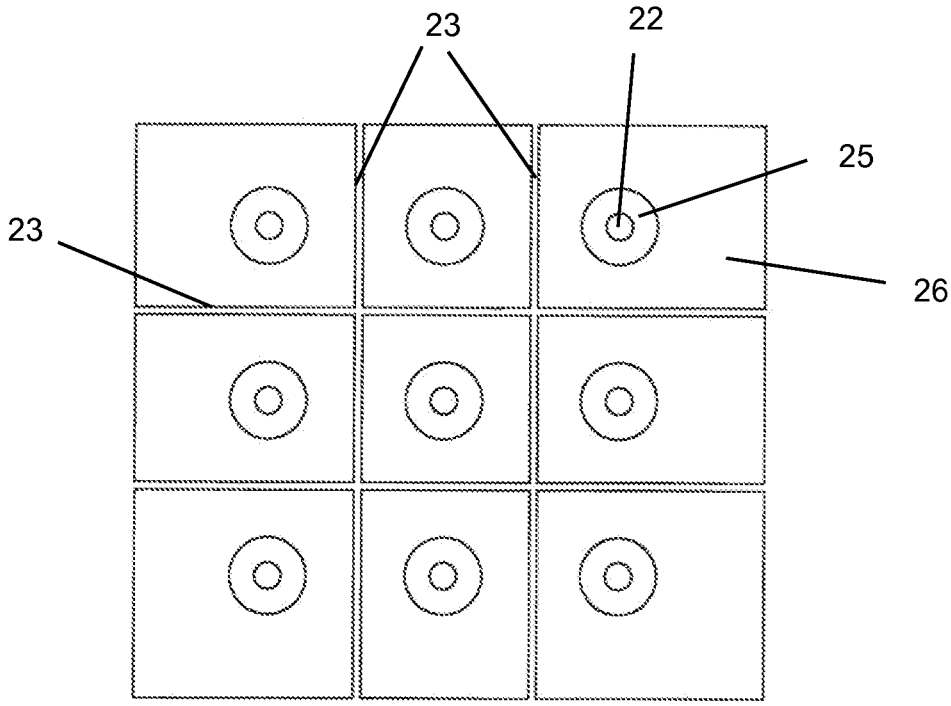
FIG. 7 shows a top view of the inner surface of the ring segment with the array of cuts to form the individual floating wall surfaces of the ring segment of the present invention.
Figure 8:
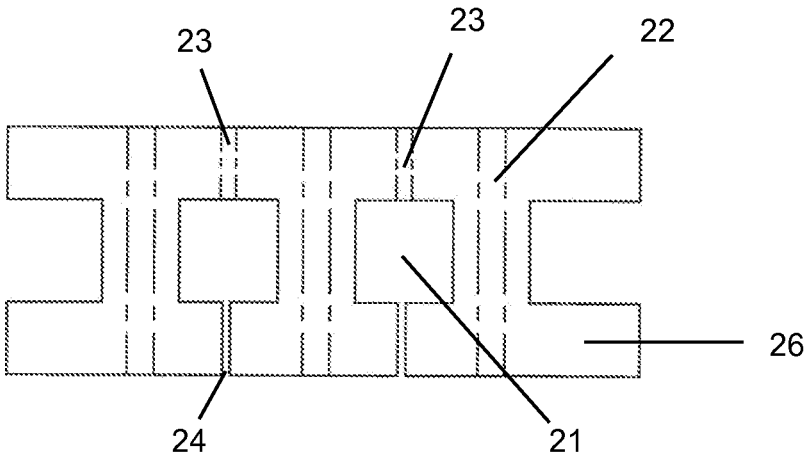
FIG. 8 shows a cross section side view through the ring segment of FIG. 7.

FIG. 7 shows a top view of the lower piece of the ring segment with vertical and axial thin cuts 24 made to form the individual floating wall surfaces 26 of the ring segment 11. Each floating wall surface 26 extends from a pedestal 25 from the upper piece of the ring segment 11. The vertical and axial cuts 24 are formed to pass into the diffusion chambers 21 so that the separate floating wall surfaces 26 are formed.

To form the ring segment 11, the ring segment is cast with the upper piece and the lower piece with the diffusion chambers 21 formed and the purge air holes 23 connecting the impingement cavity to the diffusion chambers 21. The purge air holes function as paths for the ceramic mold material that forms the diffusion chambers 21 to be leached away. This results in an unfinished ring segment as seen in FIGS. 5 and 6.

The fibrous metal pad 27 is bonded to the inner surface of the ring segment and then a TBC is applied over the pad 27. To improve the cooling capability of the ring segment, an arrangement of cooling air passages 29 can be formed on the fibrous metal pad 27 prior to bonding the pad 27 to the inner surface of the ring segment 11. The cooling air passages 29 are connected to the cooling air holes 22 and discharge onto the four sides of the floating wall surfaces 26 and then flow into the hot gas stream passing over the TBC.

Next, the thin slots 24 are cut in the lower section of the ring segment to form the individual and separated floating wall surfaces 26. The thin slots 24 are cut through the TBC and the fibrous metal pad and into the diffusion chambers 21 to form the separated floating wall surfaces 26. Before or after the cutting of the thin slots 24, the cooling air holes 22 are drilled through each pedestal 25 to form cooling air holes from the impingement cavity to the TBC surface.

The entire BOAS exterior hot wall surface is formed from multiple small pieces that form the floating wall surfaces each supported with a pedestal at the center. Partitioning of the BOAS exterior hot wall surface into these individual separated floating wall surfaces will allow for the ring segment to compensate for any thermal expansion mismatch between the cooler inner side and the hotter outer side. Also, this structure allows for the BOAS outer metal wall to include a thick TBC layer that will distort to a stress free geometry. Cooling air diffusion chambers are formed between the cooler surface and the hotter surface of the ring segment and function as thermal insulator which further minimizes any circumferential flexing of the ring segment that will decrease leakage flow across the BOAS and ensure that the circumferential hooks of the ring segment will conform to the isolation rings.

The fibrous metal pad formed between the floating wall surfaces functions as a strain isolator to compensate for any thermal expansion mismatch between the TBC and the backing element material. Also, it allows for the TBC layer to distort to a stress free geometry. Since the fibrous metal pad is made of a porous metal fiber material, it functions as a good thermal insulator for the backing substrate and allows for a large temperature drop across the pad. Cooling air channels 29 can be formed within the pad and the floating wall surface to provide for additional cooling capability. The cooling air channels can have a variety of orientations to connect the cooling air hole from the pedestal to the thin slots 24 formed around the floating wall surfaces.

The ring segment with the floating wall surfaces can be formed using a laser to cut the thin slots that separate the floating wall surfaces with the TBC and fibrous metal pads already secured onto the ring segment inner surface.

In operation, cooling air is supplied through the blade ring carrier 14 through one or more cooling air supply holes 18 to the chamber above the impingement plate 13, where the cooling air then passes through the impingement holes formed within the impingement plate 13 to produce backside impingement cooling of the ring segment. Some of the spent impingement cooling air from the impingement cavity 16 flows through the cooling air holes 22 and out through the TBC to provide film cooling air for the TBC surface. The remaining spent impingement cooling air flows through the purge air holes 23 and into the diffusion chambers 21. The cooling air from the diffusion chambers 21 then flows into the thin slots formed around the four sides of the floating wall surface to purge the inner air pocket to keep the backing substrate at the cooling air temperature and maintain the designed radius of curvature for the ring segment.

The cooling air is metered two times from the inlet supply to each individual floating wall surface to allow for the cooling air to uniformly be distributed into a cooling channel in the compliant layer and achieve a uniform heat transfer in the porous material and control the amount of cooling air to be discharged at the peripheral edges of the fibrous metal pads.

I claim the following:

1. A blade outer air seal for a turbine comprising:

a ring segment with an outer surface forming an impingement cavity and an inner surface form a hot gas surface with a forward and aft hook extending from the outer surface;

an array of diffusion chambers formed within the ring segment between the outer surface and the inner surface;

an array of thin slots formed in the inner surface and connected to the diffusion chambers;

a number of pedestals formed around the diffusion chambers; and, the array of thin slots forming a plurality of floating wall surfaces that are secured to the outer surface of the ring segment through the pedestals.

2. The blade outer air seal of claim 1, and further comprising:

the array of thin slots form rectangular shaped floating wall surfaces.

3. The blade outer air seal of claim 1, and further comprising:

a cooling air hole passing through each of the pedestals with an inlet end opening into the impingement cavity and an outlet end opening onto the hot surface of the ring segment.

4. The blade outer air seal of claim 1, and further comprising:

a fibrous metal pad secured to the floating wall surface; and, a TBC secured over the fibrous metal pad.

5. The blade outer air seal of claim 4, and further comprising:

a plurality of cooling air channels formed between the floating wall surface and the fibrous metal pad with inlets connected to the impingement cavity and outlets opening into the thin slots.

6. The blade outer air seal of claim 5, and further comprising:

a pedestal supporting each of the floating wall surfaces; and, the inlets of the cooling air channels formed between the floating wall surface and the fibrous metal pad are connected to a cooling air supply hole formed within the pedestal.

7. The blade outer air seal of claim 1, and further comprising:

each pedestal is centered on the floating wall surfaces.

8. A method of forming a ring segment for a blade outer air seal, the method comprising the steps of:

forming a ring segment with an outer surface and an inner surface with an array of diffusion chambers formed between the outer and inner surfaces and with a purge air hole connecting the diffusion chambers to the outer surface of the ring segment; and, cutting an array of thin slots from the inner surface to the diffusion chambers to form a plurality of separated floating wall surfaces.

9. The method of forming a ring segment of claim 8, and further comprising the steps of:

securing a fibrous metal pad to the outer surface of the ring segment; and, securing a TBC to the fibrous metal pad.

10. The method of forming a ring segment of claim 8, and further comprising the step of:

forming an arrangement of cooling air channels between the floating wall surface and the fibrous metal pad that open onto the sides of the floating wall surface.

11. The method of forming a ring segment of claim 8, and further comprising the steps of:

forming the diffusion chambers such that an array of pedestals are formed between the diffusion chambers; and, drilling holes through the pedestals that pass from the outer surface to the inner surface of the ring segment.

12. The method of forming a ring segment of claim 8, and further comprising the step of:

forming the separated floating wall surfaces with a rectangular shape.

* * * * *